United States Patent [19]

Macaluso

[11] 4,310,168

[45] Jan. 12, 1982

[54] PNEUMATIC WHEEL SKATE DEVICE

[76] Inventor: Mary H. Macaluso, 741 Lee Dr., Las Vegas, N. Mex. 87701

[21] Appl. No.: 119,883

[22] Filed: Feb. 8, 1980

[51] Int. Cl.[3] ..... A63C 17/08

[52] U.S. Cl. ..... 280/11.24; 280/11.25; 280/11.27

[58] Field of Search ..... 280/11.24, 11.27, 11.3, 280/47.13, 47.32, 11.25; 16/45, 46, 29

[56] References Cited

U.S. PATENT DOCUMENTS

| | | | |
|---|---|---|---|
| 430,006 | 6/1890 | Dorr | 280/11.24 X |
| 1,558,667 | 10/1925 | Bried | 280/11.24 X |
| 2,675,243 | 4/1954 | King | 280/11.24 |
| 2,980,436 | 4/1961 | Kosach | 280/11.24 |

FOREIGN PATENT DOCUMENTS

| | | | |
|---|---|---|---|
| 23681 | 2/1896 | United Kingdom | 280/11.24 |

*Primary Examiner*—Joseph F. Peters, Jr.
*Assistant Examiner*—Michael Mar
*Attorney, Agent, or Firm*—Barry Estrin

[57] ABSTRACT

A skate device includes a molded plastic form, a triangular plate and a pneumatic wheel. The plastic form is adapted to fit about the foot and has slightly downward extending forward and rear integral portions. The triangular plate is mounted under the molded form and extends along the center of the foot arch, forming the base frame of the skate to which the pneumatic wheel is attached. The wheel is secured to a bent end portion of this triangular plate at the outside of the foot. A second smaller wheel may optionally be attached to a bent end base portion of the triangular plate at the inside of the foot. The skate may be secured to the foot by laces.

10 Claims, 9 Drawing Figures

PNEUMATIC WHEEL SKATE DEVICE

BACKGROUND OF THE INVENTION

This invention relates to a form of personal transportation, and more particularly to a skate device having either one or two wheels and providing ease of movement for walking, running, coasting or standing with safety.

Roller skates are well known and have heretofore been used primarily as children's toys or adult recreational devices. Conventional roller skates have four wheels each made of metal or other hard substances which are usually exceptionally noisy during operation. Moreover, conventional roller skates elevate the skater close to the top of wheels, thus requiring the skater to make certain adjustments to the abnormal height and weight distribution caused by the elevation in order to maintain balance.

In order to overcome the disadvantages of conventional roller skates, the prior art has suggested several solutions. U.S. Pat. Nos. 2,931,012 and 2,980,436 to John J. Kosach describe single wheel skates with a large pneumatic tire capable of being tilted from the vertical by a rather complex foot and ankle supporting structure. While this prior art construction permits the wheel to be raised or lowered so that the base of the skate is near the ground, the exceptionally complex construction of these skates makes them unsuitable as a matter of expense and convenience for the every day use intended for the present invention.

Another prior art device, illustrated in U.S. Pat. No. 3,476,399 to Lawrence A. Finn, is considerably simpler than the Kosach skates. It is, however, intended solely as a two wheel skate wherein both wheels of equal size are supported by a frame attached to the bottom of the shoe. This skate, due to its construction and wheel size, cannot readily be used for fast movement with safe and easy braking and turning as is the case of the present invention.

Other prior art skate devices involving one or more wheels have from time to time been proposed, as is evident from the disclosures of U.S. Pat. Nos. 1,017,162 to Alfred Naumann; 1,445,048 to F. B. Spross; 1,332,702 to Joseph Wisniewski; 1,379,250 to C. H. Clark; and Des. 233,619 to Charles B. Kelling. A review of the foregoing patents clearly demonstrates that these prior art devices are unable to achieve the below-described objects of the present invention with its simplicity of design.

BRIEF SUMMARY OF THE INVENTION

It is an object of the present invention to provide a personal form of transportation for short distances, or distances larger than one usually wants to walk, by skate devices of considerably less complexity than conventional roller skates or those skates exemplified by the foregoing prior art patents.

Specifically, it is an object of the present invention to provide skate devices which can be used by residents in an urban area, by students and faculty on campus, by factory workers in a large plant, and by foot patrolmen and airport travelers, to name but a few, to travel short or moderately long distances in a quiet and comfortable manner with great ease by means of lightweight skate devices which are not destructive of floor surfaces, and can be easily carried and stored in small areas.

In general, these objects are accomplished by providing a novel skate device comprising a molded plastic form adapted to fit about the bottom and sides of the foot and having slightly downwardly extending forward and rear integral portions. A triangular plate is mounted under the molded plastic form along the center of the foot arch and provides support for the foot. A relatively large pneumatic wheel is mounted on and adapted to rotate about a fixed inner wheel of concave/-convex design. The wheel itself is secured to the triangular plate by insertion of the tip portion of the plate through a slot at the center of the fixed inner wheel. A lace or tether passing through openings such as grommets in the fixed center of the wheel and the plate provides means for securing the skate device to the foot.

The skate device of the present invention provides a means whereby a person may move quickly, quietly and comfortably along on two pneumatic wheels, in contradistinction to conventional roller skates which would involve eight hard, noisy wheels. Another improvement over conventional four hard-wheel roller skates is the fact that the skate device of the present invention will not elevate the rider as high on top of the wheels but rather keeps the rider fairly close to the ground with the foot semi-cradled for stability. The center-of-gravity of the rider is thereby maintained at close to its normal state and the rider does not therefore have to make as many adjustments to maintain balance as must be done to adjust to the weight and height of conventional skates.

The skate device may further include an optional second smaller wheel attached to a bent base portion of the triangular plate at the inside of each foot near the arch. The small wheel near the arch may be used as a balance aid during the time the rider learns to use the skate device of the present invention, much the same as training wheels on a bicycle. As is the case with the latter, the small wheels may be removed when the rider has become sufficiently accustomed to using the skate device or retained even then as a balance aid.

The nature and novel features which are characteristic of the present invention, as well as other objects and advantages thereof, will become more apparent from consideration of the following description taken in connection with the accompanying drawings, in which:

DETAILED DESCRIPTION OF A PREFERRED EMBODIMENT

Figure 1:
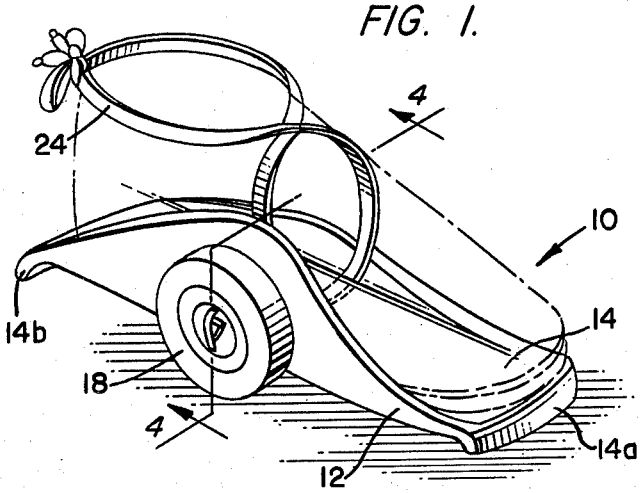
FIG. 1 is a perspective view of a first embodiment of the skate device of the present invention with a single wheel configuration in position on and connected to the right foot of the rider.
Figure 2:
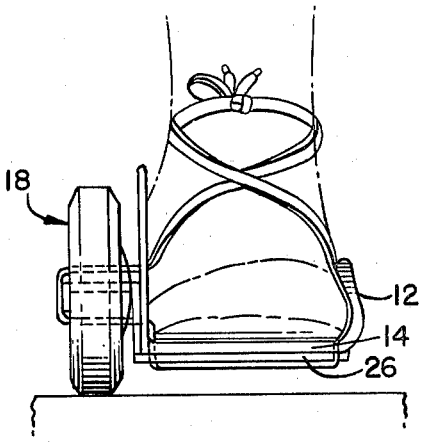
FIG. 2 is a front view of the skate device embodying the invention shown in FIG. 1.

Referring to the drawings in detail, and in particular to FIGS. 1–4, a first embodiment 10 of the skate device of this invention is illustrated as mounted on the right foot of the rider. The skate device 10 comprises, principally, a molded plastic form 12, a pneumatic wheel 18, and a triangular plate 26 of metal or any suitable hard material capable of supporting the weight of the rider.

The molded plastic form 12 includes an integrally formed sole portion 14 upon which the foot rests. The plastic form may be molded to conform to the contour of the bottom and sides of the foot. At either end, the sole portion 14 extends downward slightly defining the toe and heel integral extensions 14*a* and 14*b* of the molded plastic form 12. These extensions may be used as a braking aid and as an aid for standing while the rider is at rest.

Figure 3:
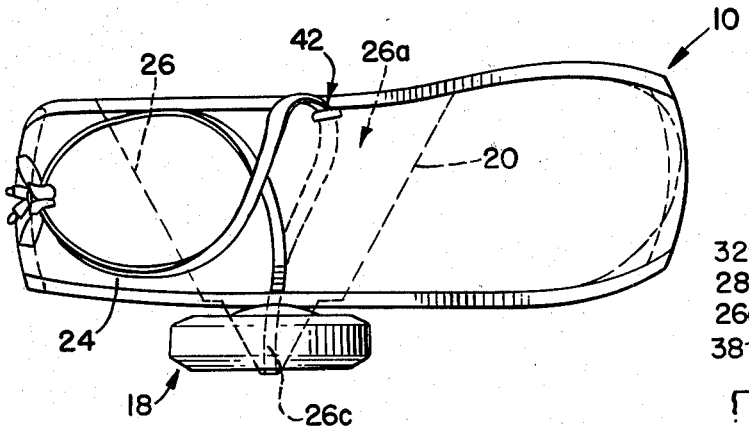
FIG. 3 is a plan view of the skate device illustrated in FIG. 2.
Figure 4:
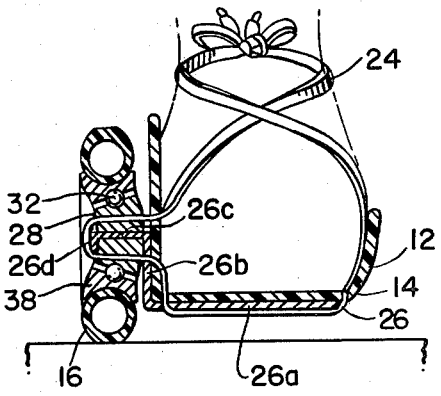
FIG. 4 is a vertical transverse cross-sectional view taken along line 4—4 of FIG. 1.

The triangular plate 26 is mounted on the underside of the plastic form 12, as may be seen in FIGS. 3 and 4. Referring to FIG. 4, and more particularly to FIG. 5, the plate 26 is illustrated as comprising a horizontal base portion 26*a*, an upward vertically extending portion 26*b*, and a horizontal point portion 26*c* which includes a downward bent tip 26*d*.

This configuration may be formed simply by bending a planar triangular plate to meet the required dimensions of the skate device. For example, for a pneumatic wheel with an 11 cm. diameter, a triangular plate with a 15 cm. base and 16 cm. legs may be used. The plate may be bent vertically upward approximately 5 to 6 cm. from the triangular point, leaving a horizontal base portion 26*a* of about 10 cm. The vertical portion may then be further bent outwards about 2 cm. from the point, leaving the vertical portion 26*b* and the horizontal point portion 26*c*.

Figure 5:
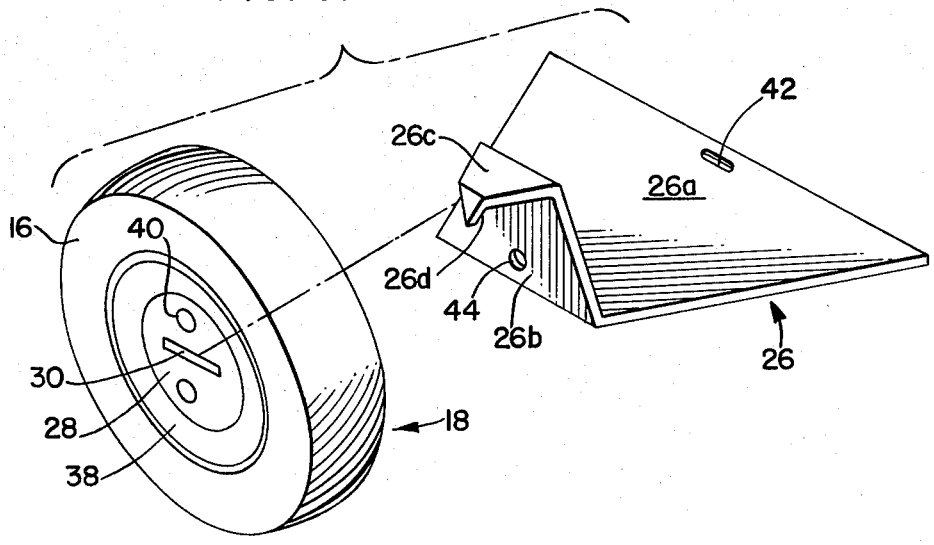
FIG. 5 is an exploded perspective view of the triangular plate and wheel of the skate device, illustrating the mounting means therebetween.
Figure 6:
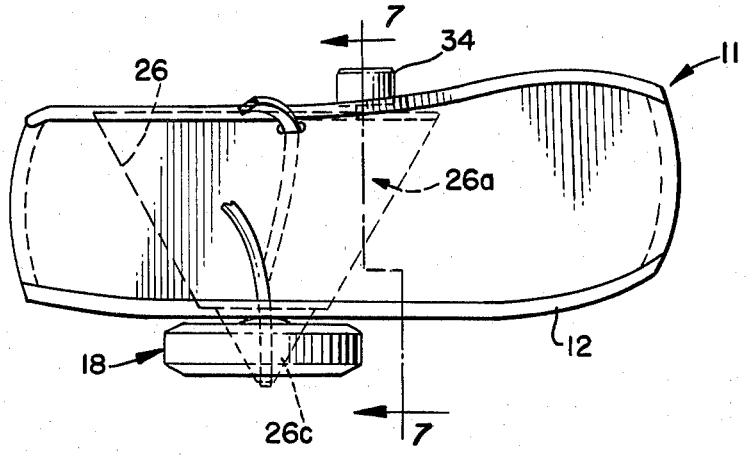
FIG. 6 is a plan view of a second embodiment of the skate device of the present invention illustrating the addition of a second wheel.
Figure 7:
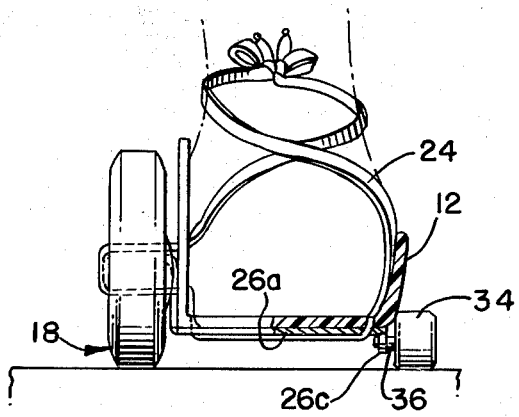
FIG. 7 is a transverse cross-sectional view taken along line 7—7 of FIG. 6.
Figure 8:
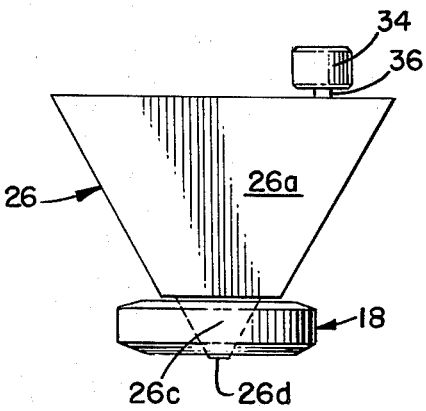
FIGS. 8 and 9 are, respectively, a plan view and an exploded perspective view of the wheel mounting means, illustrating the mounting between the triangular plate and the large and small wheels.
Figure 9:
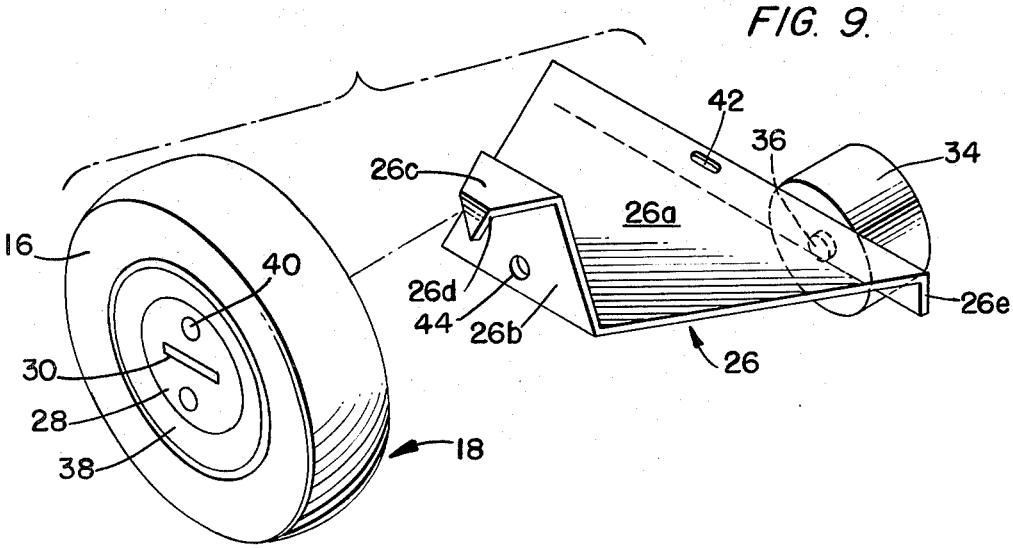

The so configured triangular plate, when mounted to the molded plastic form 12 by any well known, suitable mounting means, such as nuts and bolts or adhesives (not illustrated), will be positioned so that the horizontal base portion 26*a* passes under the center of the foot at the arch and the upward vertical portion 26*b* extends outside the foot near the cuboid. The horizontal point portion 26*c* is inserted through a slot 30 at the center of a fixed inner wheel 28. It is thereafter bent downward as shown in FIG. 5 to form the downward bent tip portion 26*d* of the triangular plate, thereby securing the plate 26 to the fixed center 28 of the wheel.

The wheel 18 comprises a pneumatic tire 16 mounted on a rim 38, both of which rotate together about the fixed inner wheel 28 by means of ball bearings 32. The fixed inner wheel is shaped so as to define a concave surface facing outward from the foot and a convex surface facing inward to facilitate mating and mounting with the triangular plate as is illustrated in FIG. 4.

The skate device is completed with suitable means for mounting to the foot such as, for example, the tether fastening laces 24 illustrated in FIGS. 1–4. The tether, which may be made of fabric or leather, is inserted through two grommets 40 in the fixed center 28 of the wheel, one below and one above the slot 30. A small hole 42 is provided at the base of the triangular plate 26 near the inside of the foot, through which the tether can pass. Another small hole 44 may be provided in the vertically extending portion 26*b* of the triangular plate, through which the tether may also pass to the grommets 40. The ends of the tether may, for example, be conveniently tied behind the ankle, as shown in FIG. 1.

In FIGS. 6–9, with the like elements designated by the same numerals as in FIGS. 1–5, a second embodiment 11 of the present invention is illustrated with the addition of a second small wheel 34. Modification of the triangular plate 26 is necessary to accommodate the second wheel, as is shown more particularly in FIGS. 7 and 9. The horizontal base 26*a* of the plate 26 is further bent downward to form a downward extending base portion 26*e*. In the specific example described earlier in connection with the first embodiment, this triangular plate portion 26*e* may extend downward about 2 cm.

The small wheel 34 is affixed to the downward extending base portion 26*e* by suitable mounting means such as an axle pin 36. The small wheel 34 is generally located at the inside of the foot near the arch.

While the triangular plate modification with downward extending base portion 26*e* has been described specifically with respect to the embodiment of FIGS. 6–9, it will be understood that this triangular plate configuration may also be used with the single wheel embodiment of FIGS. 1–6. This will, of course, result whenever the second wheel 34, when used as a training wheel, is removed after the rider has gained sufficient confidence in using the skate device of the present invention. Moreover, it will permit the same skate device to be used by experienced and beginner riders interchangeably by the simple removal or addition of the second wheel.

While particular embodiments of the invention have been described for purposes of illustration, it will be understood that various changes and modifications can be made therein within the spirit of the invention, and the invention accordingly is not to be taken as limited except by the scope of the appended claims.

What is claimed is:

1. A skate device adapted for attachment to a foot and designed to provide ease and safety of movement for walking, running, coasting and standing comprising:

(a) a molded plastic form adapted to fit about the foot;

(b) a triangular plate mounted under the plastic form, said plate extending beneath the sole of the foot along the center of the arch and positioned so that its base is at the inside of the foot near the arch and its point is at the outside of the foot; said plate configured so as to comprise a main horizontal part extending beneath the sole of the foot, a vertical part extending upward at the outside of the foot approximately perpendicular to said main part, and a portion containing the point extending outward from said vertical part; and (c) a pneumatic wheel adapted to rotate about a fixed center, the point of said triangular plate passing through an aperture in the fixed center so as to secure the wheel to the plate.

2. The skate device defined in claim 1, further comprising a second wheel attached to the base of the triangular plate facing the inside of said foot.

3. The skate device defined by claim 2, wherein the triangular plate further includes a portion extending downward from said main part at the base of said plate, the second wheel being attached to said downward extending portion.

4. The skate device of claim 1 wherein the wheel rotates about a fixed center, the wheel being attached to the triangular plate by inserting the point of the plate through a slotted aperture in the fixed center and then bending the end of the outward extending portion of the plate downward so that the point faces down.

5. The skate device of claim 4 wherein the skate device is secured to the foot by means of a tether passing through holes in the fixed center of the wheel.

6. The skate device of claim 1 wherein the molded plastic form includes downward extending forward and rear integral portions.

7. The skate device of claim 4 wherein the fixed center of the wheel is shaped so that its surface is concave on the side facing outward from the foot and convex on the side facing inward to the foot.

8. A skate device adapted for attachment to a foot and designed to provide ease and safety of movement for walking, running, coasting and standing comprising:

(a) a molded plastic form adapted to fit about the foot;

(b) a triangular plate mounted under the plastic form, said plate extending beneath the sole of the foot along the center of the arch and positioned so that its base is at the inside of the foot near the arch and its point is at the outside of the foot; and (c) a pneumatic wheel adapted to rotate about a fixed center and attached to the triangular plate at the outside of the foot, the point of the plate passing through a slotted aperture in the fixed center of the wheel and then downward at the outside of the wheel so that the point faces down.

9. The skate device of claim 8 wherein the skate device is secured to the foot by means of a tether passing through holes in the fixed center of the wheel.

10. The skate device of claim 8 wherein the fixed center of the wheel is shaped so that its surface is concave on the side facing outward from the foot and convex on the side facing inward to the foot.

* * * * *